United States Patent [19]

Craig

[11] 4,058,241

[45] Nov. 15, 1977

[54] COVERED GARMENT HANGER

[76] Inventor: Helen C. Craig, 6307 Augusta Road, Greenville, S.C. 29605

[21] Appl. No.: 612,668

[22] Filed: Sept. 12, 1975

[51] Int. Cl.[2] ..... A47J 51/094

[52] U.S. Cl. ..... 223/98

[58] Field of Search ..... 223/98, 88, 85; D3/257, D3/247; 24/115 N

[56] References Cited

U.S. PATENT DOCUMENTS

| | | | |
|---|---|---|---|
| 1,885,263 | 11/1932 | Hulett | 223/98 X |
| 2,192,237 | 3/1940 | Nettles | 223/98 |
| 2,423,408 | 7/1947 | Sedacca et al. | 223/88 X |
| 2,590,811 | 3/1952 | Zimmerman et al. | 223/98 X |
| 2,711,331 | 6/1955 | Temple | 24/115 N |

FOREIGN PATENT DOCUMENTS

| | | | |
|---|---|---|---|
| 739,195 | 10/1955 | United Kingdom | 223/88 |

*Primary Examiner*—George H. Krizmanich
*Attorney, Agent, or Firm*—Bailey, Dority & Flint

[57] ABSTRACT

This invention relates to covered garment hangers wherein a tightly braided cover is plaited around the periphery of a triangular bar coat hanger providing an improved substantially flat garment supporting surface for protecting the garment supported thereon while reducing creasing and slippage of the garments.

4 Claims, 7 Drawing Figures

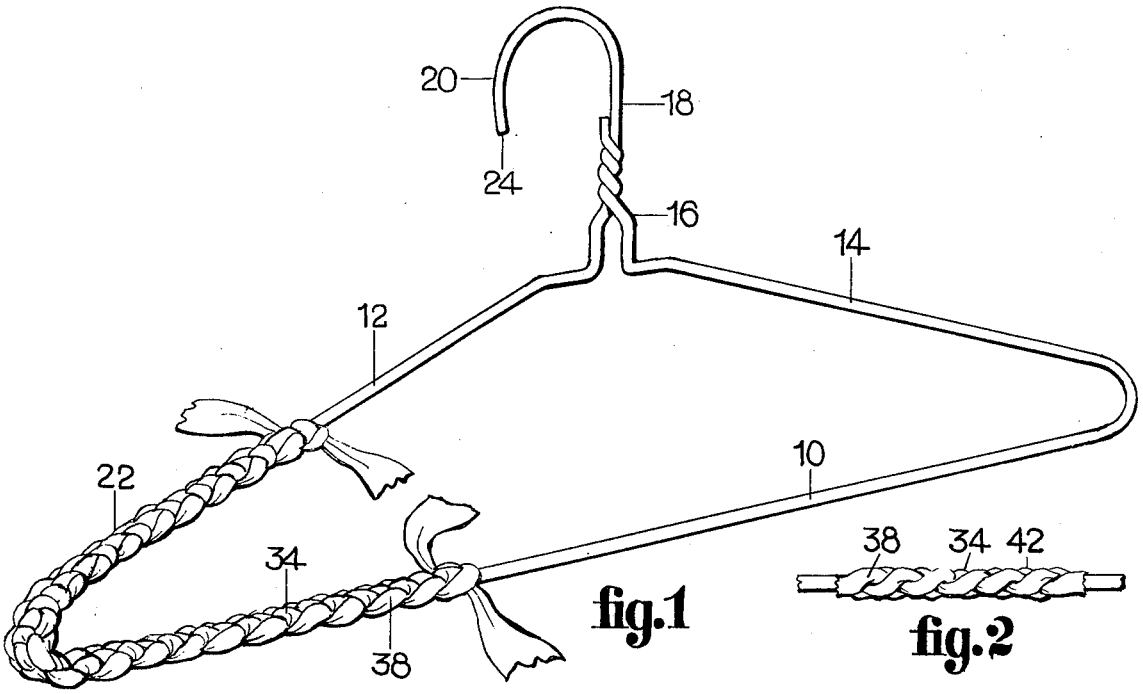
fig.1
fig.2
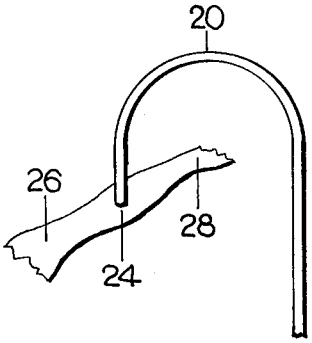
fig.3
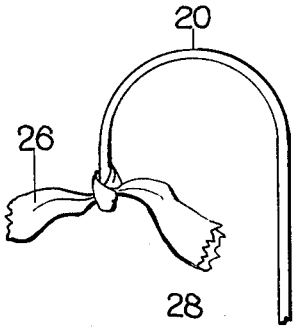
fig.4
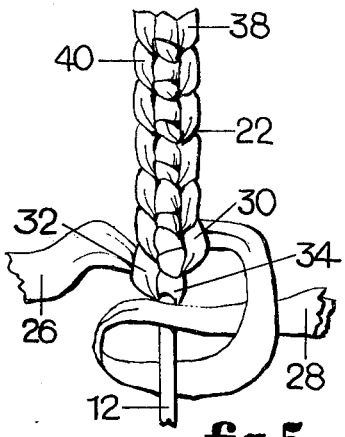
fig.5
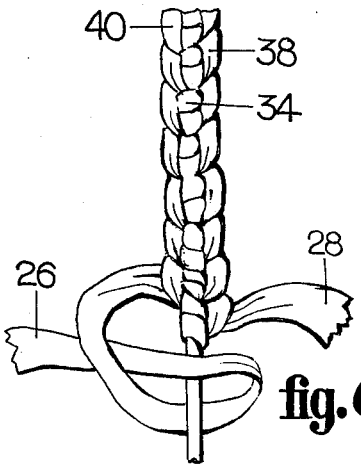
fig.6
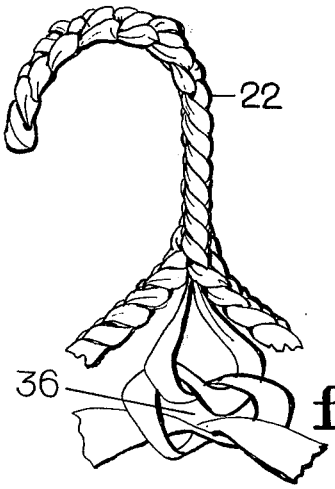
fig.7

COVERED GARMENT HANGER

BACKGROUND OF THE INVENTION

Heretofore, covers for conventional wire coat hangers have been known wherein the cover was crocheted or knitted around the triangular periphery of the coat hanger. However, such a cover was mainly for ornamental purposes and often became loose on the coat hanger and often, the loosely crocheted loops would slip and twist about the coat hanger wire after prolonged use thereof. Problems have also been encountered with such coverings wherein the end of the hook portion of the hanger pierces through the covering causing the covering to slide downwardly over the hook portion often resulting in the partial or complete unravelling of the covering thereon. Prior coverings have typically been crocheted or constructed from soft cotton or woolen yarns which tend to easily stretch producing slippage and twisting causing the cover to eventually loose its shape.

SUMMARY OF THE INVENTION

A garment hanger is provided comprising a horizontal cross bar, and a pair of upwardly converging shoulder bars integral with opposing ends of the cross bar providing a pair of garment supporting shoulders terminating in a Y-shaped neck junction. An end of one of the shoulder bars extends upwardly to form a suspension hook having a shank portion and a substantially U-shaped hook portion. A braided cover is formed from a stretchable fabric braided over said hanger.

The braid is constructed by placing an end tip of the hook portion in the center of a strand of the fabric defining a first strand of fabric on one side of the tip and a second strand of said fabric on the opposite side of the tip. The fabric is held firmly on the tip, while initially working the first fabric strand under and then over the hanger hook portion and then pulling the strand tightly through the loop thus formed, and then braiding the second fabric strand in the same manner to form a braid over and covering the end tip. The remaining hanger bar is now covered by first working the first fabric strand under and then over the hanger bar and then pulling the strand tightly through the loop thus formed, and second, by working the second fabric strand under then over the hanger bar and then pulling the strand tightly through the loop thus formed. The above two steps are repeated to braid the cover over the entire suspension hook, over one branch of the neck junction downwardly over the shoulder bar, over the cross bar, upwardly over the other shoulder bar, and up to the neck junction whereat the first and second fabric strands are knotted together to finish the braided cover. Thus, a tightly braided cover is provided for supporting garments thereover having a substantially flat surface of wider surface area than said hanger bar portions.

Accordingly, an important object of the present invention is to provide a covered garment hanger with a tightly braided cover having a substantially planar surface of sufficient width to provide an improved garment supporting surface.

Another important object of the present invention is to provide a covered garment hanger having a braided covering which will retain its shape and stay in place.

Another important object of the present invention is to provide a covered garment hanger having a braided cover constructed from a fabric which will stretch sufficiently as it is braided to form a tight cover over the hanger.

Another important object of the present invention is to provide a covered garment hanger wherein the cover will prevent the hanger bar from rusting from beneath the cover.

Another important object of the present invention is to provide a covered garment hanger having a plaited cover which is constructed using a braided loop pattern which will effectively cause the braids to tighten upon the hanger as the braided loops are formed.

Still another important object of the present invention is to provide a covered garment hanger having a braided covering wherein the tendency of the covering to slide over the tip of the hook end is reduced.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating a garment hanger wherein a braided cover is constructed in accordance with the present invention, FIG. 2 is a partial side elevational view of a garment hanger having a cover constructed in accordance with the present invention, FIG. 3 is a elevational view of a suspension hook portion of a garment hanger illustrating the initial step in constructing a braided cover in accordance with the present invention, FIG. 4 is a elevational view of a suspension hook portion of a garment hanger illustrating the initial braiding loop which is formed to begin the construction of a braided cover in accordance with the present invention, FIG. 5 is a cut-away top plan view of a garment hanger having a braided cover constructed in accordance with the present invention wherein the right hand strand of fabric is braided, FIG. 6 is a fragmented top plan view of a garment hanger having a braided cover constructed in accordance with the present invention wherein the left hand fabric strand is braided, and FIG. 7 is a partial side elevational view illustrating a garment hanger having a braided cover constructed in accordance with the present invention wherein the construction of the braid is completed.

DESCRIPTION OF A PREFERRED EMBODIMENT

The drawing illustrates a garment hanger comprising a horizontal cross bar 10 and a pair of upwardly converging shoulder bars 12 and 14 integral with the opposing ends of the cross bar 10 providing a pair of garment supporting shoulders which terminate in a Y-shaped neck junction 16. An end of one of the shoulder bars extends upwardly to form a suspension hook having a shank portion 18 and a substantially U-shaped hook portion 20. A braided cover 22 formed from a semi-elastic, mesh nylon twill fabric such as calico or gingham is constructed over the hanger bar portion 10, 12, 14 and the suspension hook 20. The semi-elastic properties and mesh pattern of the nylon twill fabric are similar to that of conventional nylon hosiery. The advantageous loop construction of the braid which is utilized to construct the cover combined with the semi-elastic properties of the nylon fabric provide a tight cover construction over the hanger bar portions having a substantially flat surface for supporting garments thereover while reducing the tendency of the garments to slip and crease on the garment hanger.

Approximately ten yards of yarn twill fabric having a width of approximately 1½ inches is utilized to construct the cover 22. However, a narrower strip of fabric may be advantageously utilized by using a double length of fabric such as 20 yards and folding the length in half to provide a double strand which has been braided instead of a single strand. In any instance, however, the width of the strip is folded upon itself to form a double thickness of fabric to provide more strength and stretchability to the fabric strands as they are pulled through the loops to form a tight cover construction.

Initially, with the material folded in half widthwise, the tip 24 of the hook portion 20 is placed in the center of the fabric strip both lengthwise and widthwise to define a left hand strand of fabric 26 on one side of the tip 24 and a right hand strand of fabric 28 on the other side of the tip. With the left thumb and forefinger firmly holding the fabric on the tip 24 the right hand or first strand of fabric 28 is brought under the hanger bar and over the bar through the loop thus formed and pulled tightly to form the initial loop about the hanger tip. Now holding the tip of the hanger firmly with the right hand to maintain the fabric on the tip, the left hand or second strand of fabric 26 is brought under the hanger then over and through the loop thus formed and pulled tightly to form the second loop or braid. With the initial braid formed over and covering the tip 24 of the hanger, the tendency of the cover to slide over the tip and the hook is reduced. The remaining hanger bar portions may be braided by repeating the following two steps. First, working the right hand or first strand of fabric 28 under then over the hanger bar and then pulling the strand tightly through the loop thus formed, as best shown in FIG. 5 and second, working the left hand or second fabric strand 26 under then over the hanger bar and then pulling the strand tightly through the loop thus formed, as best shown in FIG. 6.

Referring to FIGS. 5 and 6, it can be seen that the working strand which is being braided at any instance is always the strand which is above the other strand. For example, in FIG. 5, the right hand strand of fabric 28 coming through the loop 30 is above the left hand strand of fabric 26 which comes through the loop 32. Therefore, by always working the above strand through a loop, the intermediate braid or loop such as 34 is not only pulled tightly by pulling strand 26 but is also tightly compressed between the loop formed by pulling strand 28 at the same time. Thus, not only are the loops being formed tightly constructed about the hanger bar, since the strands 26 and 28 are pulled tightly outwardly against each other during the braiding of each loop, but the previous loop that was formed is also tightly pressed between the strand being worked. The above two steps are repeated until the braiding covers the entire suspension hook 20 and shank 18, over one branch of the neck junction 16 downwardly over the shoulder bar 12, over the cross bar 10, upwardly over the other shoulder bar 14 and back to the neck junction 16 whereat the left and right hand fabric strands 26 and 28 are knotted together to finish the braided cover at 36, as shown in FIG. 7.

As best shown in the plan views of FIGS. 5 and 6, the cover 22 so constructed comprises a plurality of center loops 34, a plurality of outer parallel braided loops 38 adjacent one side of the center loops 34, and a plurality of outer parallel braided loops 40 adjacent the opposite side of the center loops 34 providing a substantially flat surface 42 over the hanger bar portions 10 through 14 over which garments may be supported for effectively reducing slipping and creasing of the garments thereon.

The cover so constructed not only provides an improved garment supporting surface, but protects the hanger bar frame beneath the cover from rusting, particularly at sea-side locations, and from other soiling particles which can come off on the garments being supported. The mesh, semi-elastic nylon fabric provides a tightly braided cover over the hanger bar frame of the garment hanger which is highly effective for retaining its shape on the hanger and for maintaining the shape of the substantially flat garment supporting surface thereon.

While a preferred embodiment of the invention has been described using specific terms, such description is for illustrative purposes only, and it is to be understood that changes and variations may be made without departing from the spirit or scope of the following claims.

What is claimed is:

1. A covered garment hanger including a substantially triangular-shaped bar frame comprising:

a. a horizontal cross bar;

b. a pair of upwardly converging shoulder bars integral with opposing ends of said cross bar providing a pair of garment supporting shoulders terminating in an inverted Y-shaped neck junction;

c. an end of one of said shoulder bars extending upwardly to form a suspension hook bar having a shank portion and a substantially U-shaped hook portion;

d. a semi-elastic fabric strand for being braided over said hanger;

e. a medial portion of said strand being placed against an end tip of said hook portion to form a first fabric strand on one side of said tip and a second fabric strand on the opposite side of said tip with said fabric strand secured about said tip;

f. said first fabric strand being initially looped under and then over the hook bar portion and then pulled tightly through the loop thus formed with said second fabric strand being subsequently worked under and then over the hook bar portion and then pulled tightly through the loop thus formed to form a braid over and covering said end tip;

g. said first fabric strand being then looped under and then over said hanger bar and then pulled tightly through the loop thus formed to form a first series of braided loops laterally adjacent one side of said hanger bar;

h. said second fabric strand being looped under then over said hanger bar and then pulled tightly through the loop thus formed to form a second series of braided loops laterally adjacent the other side of said hanger bar;

i. said first and second strands being looped as in paragraphs (g) and (h) to form said braided cover over said entire suspension hook, over one branch of said neck junction downwardly over said shoulder bar, over said cross bar, upwardly over said other shoulder bar and up through said neck junction to entirely cover said garment hanger;

j. said first and second fabric strands being secured together at said neck junction to finish said braided cover; and k. said first and second series of braided loops providing a substantially flat garment supporting surface of wider surface area than said hanger bar portions reducing slipping and creasing of said garments thereon.

2. The garment hanger set forth in claim 1 wherein said fabric strand comprises a strand of nylon twill fabric having sufficient elasticity to be stretchable to provide tightly braided loops of said cover.

3. The garment hanger set forth in claim 2 wherein said nylon twill fabric comprises a strip having a width of approximately one and one-half inches.

4. The garment hanger set forth in claim 3 wherein said fabric strip is folded upon itself to form a strip of double thickness for constructing said braided cover.

* * * * *